US008424783B2

(12) United States Patent
Huang

(10) Patent No.: US 8,424,783 B2
(45) Date of Patent: Apr. 23, 2013

(54) WALL MOUNTED SHOWER HEAD

(76) Inventor: Somei Huang, Tai Ping (TW)

( * ) Notice: Subject to any disclaimer, the term of this patent is extended or adjusted under 35 U.S.C. 154(b) by 344 days.

(21) Appl. No.: 12/929,401

(22) Filed: Jan. 21, 2011

(65) Prior Publication Data

US 2012/0186667 A1 Jul. 26, 2012

(51) Int. Cl.

| | |
|---|---|
| ***B05B 1/18*** | (2006.01) |
| ***B05B 1/14*** | (2006.01) |
| ***B05B 1/30*** | (2006.01) |
| ***B05B 15/08*** | (2006.01) |

(52) U.S. Cl.
USPC ..... 239/583; 239/558; 239/559; 239/567; 239/587.4

(58) Field of Classification Search ..... 239/282, 239/443, 447, 537, 541, 548, 558, 559, 567, 239/569, 578, 579, 583, 587.1, 587.3, 587.4, 239/596; 251/230, 319–323
See application file for complete search history.

(56) References Cited

U.S. PATENT DOCUMENTS

| | | | | |
|---|---|---|---|---|
| 5,704,397 | A * | 1/1998 | Lu | 137/630.15 |
| 6,131,608 | A * | 10/2000 | Lu | 137/550 |
| 6,942,195 | B2 * | 9/2005 | Kao | 251/339 |
| 7,325,754 | B2 * | 2/2008 | Mukai | 239/583 |
| 7,341,239 | B2 * | 3/2008 | Hodel et al. | 251/230 |
| 8,028,356 | B2 * | 10/2011 | Kao et al. | 4/678 |
| 2012/0012676 | A1 * | 1/2012 | Hu | 239/525 |

* cited by examiner

*Primary Examiner* — Darren W Gorman
(74) *Attorney, Agent, or Firm* — Guice Patents PLLC

(57) ABSTRACT

The present invention provides a wall mounted shower head including a casing body set, a water conduit set and a water outlet plate. The water conduit set is disposed inside the casing body set, wherein upper section of the water conduit set is joined to a first joining base of the water outlet plate and bottom section of the water conduit set is joined to a second joining base of the casing body set. With a two-stage press control button disposed on the water outlet plate, users can control shower water by controlling actuation of an upper control shaft, a lower control shaft and a spring of the water conduit set. The structure provides a convenient water control operation for users in shower.

6 Claims, 7 Drawing Sheets

WALL MOUNTED SHOWER HEAD

BACKGROUND OF THE INVENTION

1. Field of the Invention

The present invention relates to a wall mounted shower head, and more particularly, to a wall mounted shower head providing a convenient water control operation.

2. Brief Description of the Related Art

The structure of existing wall mounted shower head, as illustrated in FIG. 1, mainly comprises an outer casing 11, a water outlet cap 12 and a water conduit base 13; wherein a ball joint tube 14 disposed at and surrounds the outer casing 11, and one end of the water conduit base 13 contacts the water outlet cap 12. The ball joint tube 14 is attached to the shower water pipe on the wall. To control the shower water, a water control handle is disposed on the wall underneath the wall mounted shower head 1 (not illustrated). As users are in the shower washing their hair, it is very likely that they have to turn off the water to prevent the shampoo from being washed away before their hair is cleaned; however, users have to bend down to reach the foregoing water control handle due to its lower position. This often causes water or shampoo getting into the eyes or the waste of water, and hence is not very user-friendly.

SUMMARY OF THE INVENTION

In order to overcome the deficiencies of the preceding prior art, a primary object of the present invention is to provide a wall mounted shower head providing a convenient water control operation.

With the above object in mind, the present invention provides a wall mounted shower head comprising a casing body set, a water conduit set and a water outlet plate. The water conduit set is disposed inside the casing body set, wherein upper section of the water conduit set is joined to a first joining base of the water outlet plate and bottom section of the water conduit set is joined to a second joining base of the casing body set. With a two-stage press control button disposed on the water outlet plate, users can control shower water by controlling actuation of an upper control shaft, a lower control shaft and a spring of the water conduit set. The structure provides a convenient water control operation for users in shower.

BRIEF DESCRIPTION OF THE INVENTION

The detail structure, the applied principle, the function and the effectiveness of the present invention can be more fully understood with reference to the following description and accompanying drawings, in which.

DETAILED DESCRIPTION OF THE PREFERRED EMBODIMENTS

Figure 1:
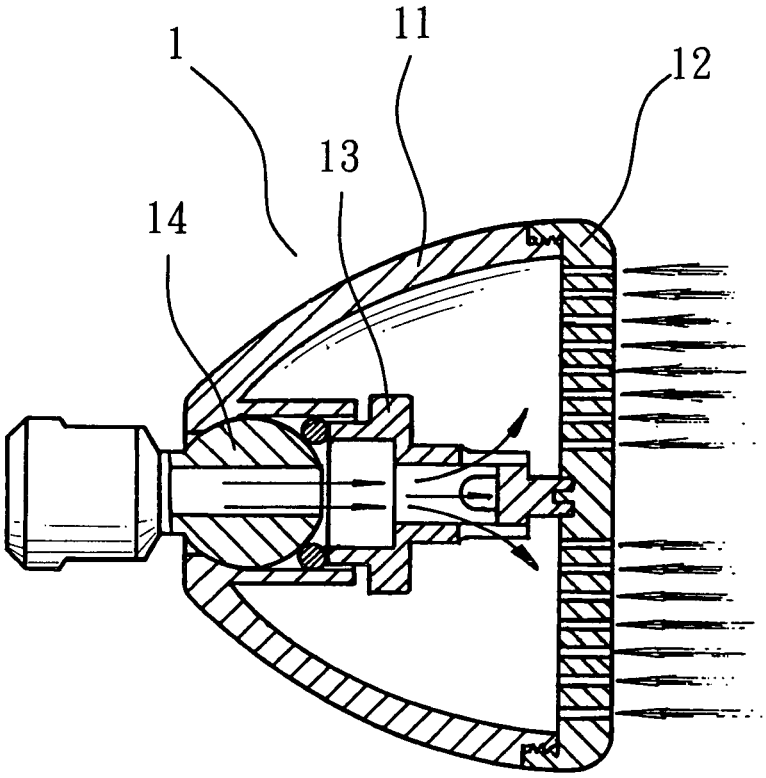
FIG. 1 PRIOR ART
FIG. 1 is a sectional view of a wall mounted shower head according to the prior art.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

Figure 2:
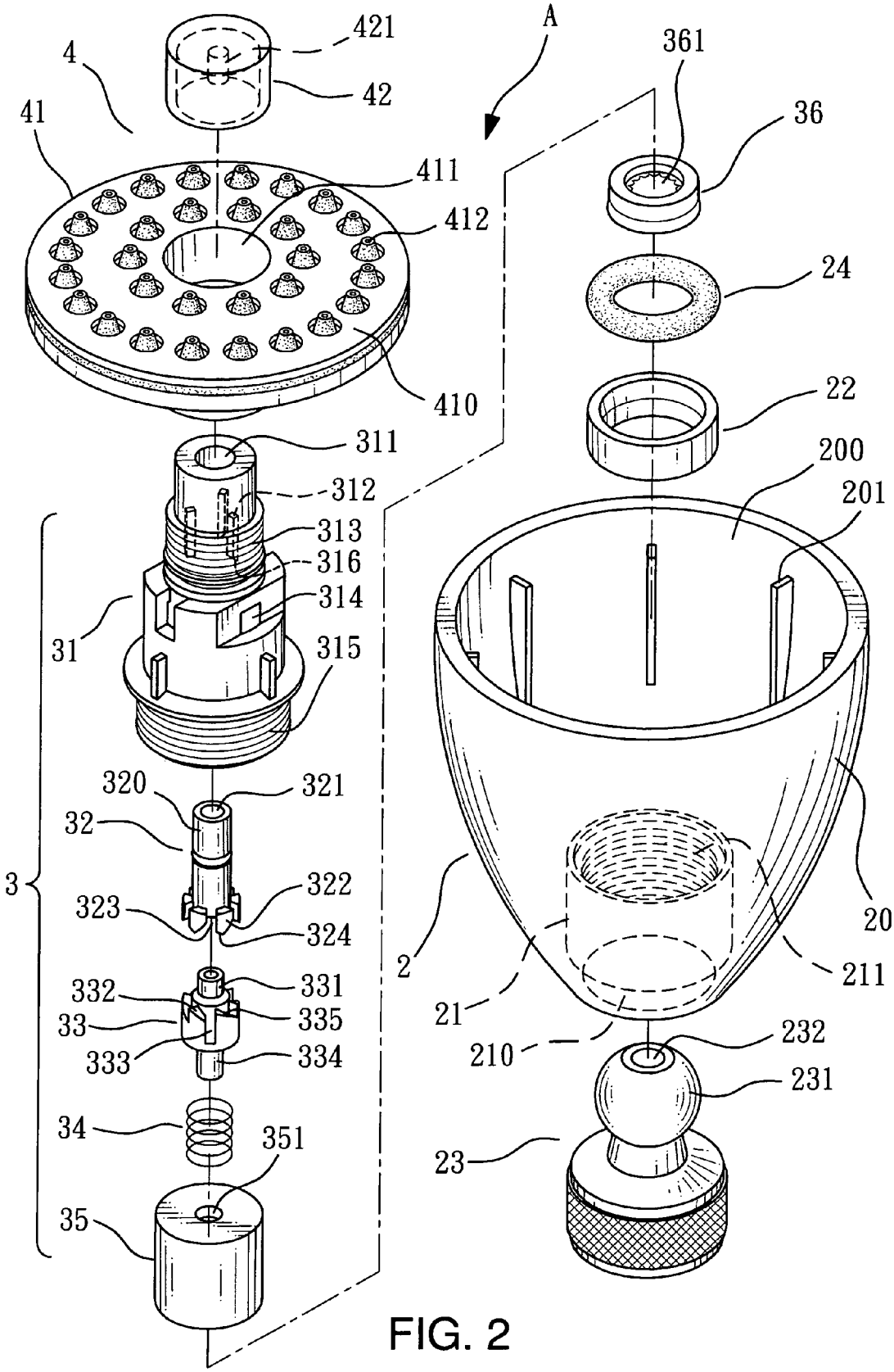
FIG. 2 is an exploded perspective view according to the present invention.
Figure 3:
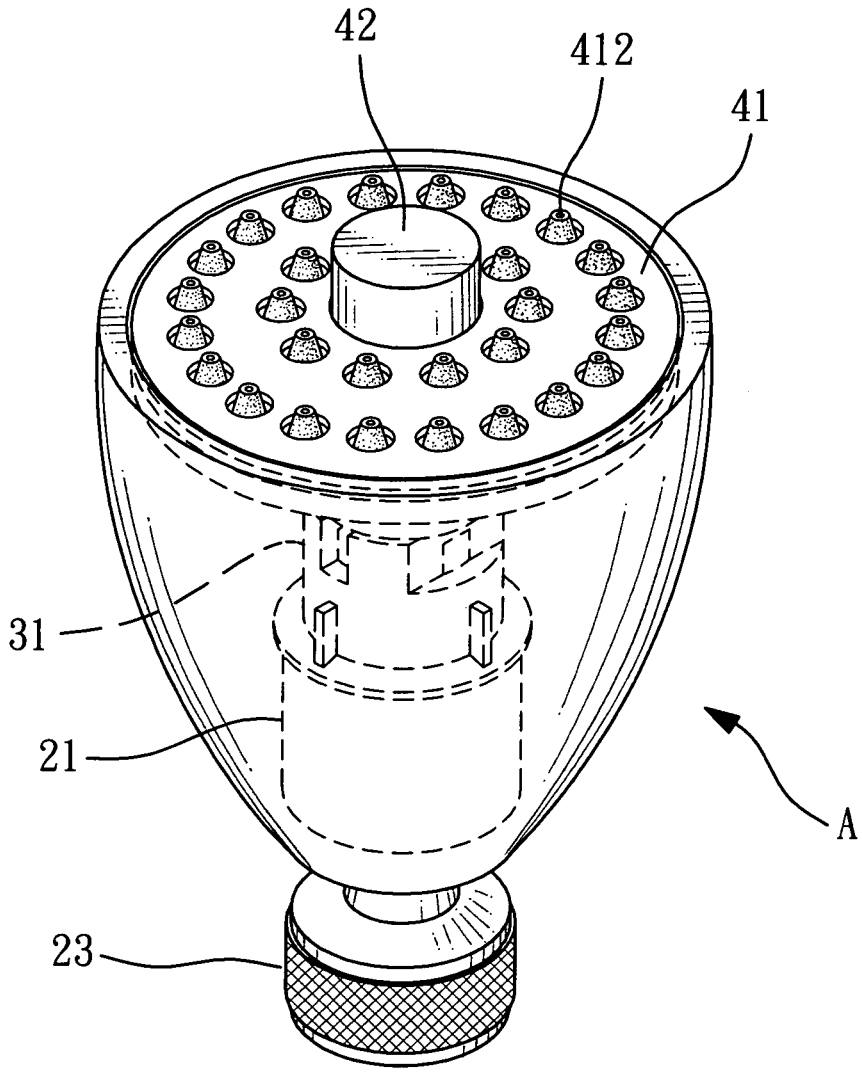
FIG. 3 is a perspective view according to the present invention.
Figure 4:
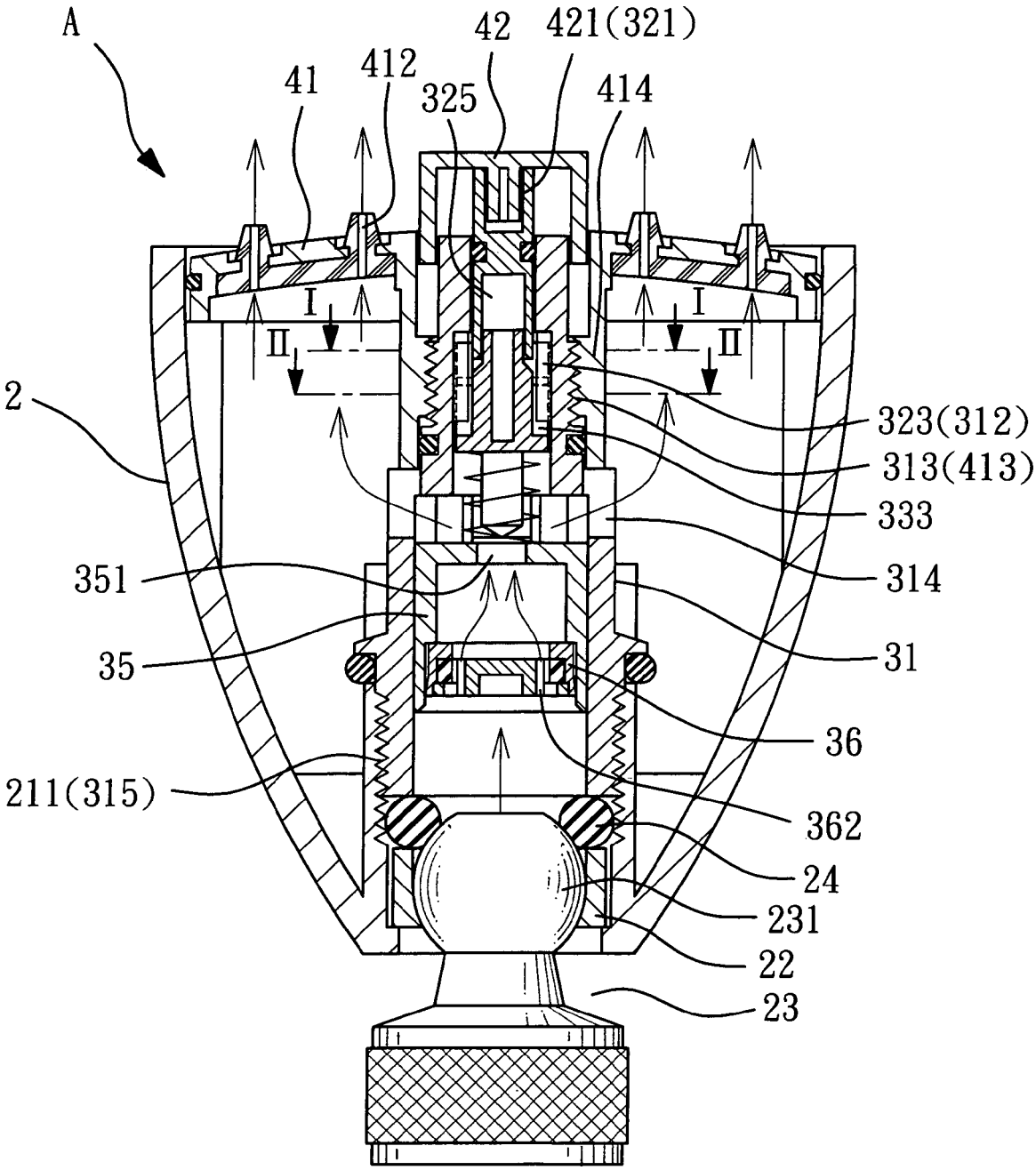
FIG. 4 is a sectional view of wall mounted shower head discharging water according to the present invention.

Referring to FIGS. 2, 3 and 4, wherein a wall mounted shower head A comprises a casing body set 2, a water conduit set 3 and a water outlet plate 4. The water conduit set 3 is disposed inside the casing body set 2, wherein upper section of the water conduit set is joined to a first joining base of the water outlet plate 4 and bottom section of the water conduit set is joined to a second joining base of the casing body set 2.

The casing body set 2 is an outer casing 20, wherein the outer casing 20 has a hollow receiving chamber 200; and inner side of the hollow receiving chamber 200 is disposed of a plurality of support ribs 201 to support and limit the position of the water outlet plate 4. Further, bottom part of the hollow receiving chamber 200 is disposed a second joining base 21 having a first through hole 210 and a first inner thread section 211; wherein a ball joint tube 23 can be disposed at and surrounds the first through hole 210. The ball joint tube 23 provides a ball body 231 having a penetration hole 232; wherein the ball body 231 is disposed between a water-stop pad 22 and a water-stop ring 24.

The water conduit set 3 comprises parts described hereinafter.

A water conduit base 31 having a second through hole 311, wherein inner wall of the second through hole 311 is disposed of a plurality of guide ribs 312; the guide ribs 312 has a slant surface 316 at the bottom end thereof. Upper section of the water conduit base 31 is disposed of a first outer thread section 313, wherein at least one water outlet 314 is disposed below the first outer thread section 313; a second outer thread section 315 is provided at the lower section of the water conduit base 31 and is fixedly joined to the first inner thread section 211 of the casing body set 2.

An upper control shaft 32 disposed through the second through hole 311, wherein shaft body 320 of the upper control shaft 32 has a third through hole 321 and a fourth through hole 325. The shaft body 320 further provides a plurality of stop pieces 322 at the lower section thereof, wherein the plurality of stop pieces 322 has a slant cone part 324 at the bottom thereof and a first groove 323 is disposed between each two stop pieces 322.

A lower control shaft 33 having a first cylinder body 331, wherein the first cylinder body 331 fits with the fourth through hole 325 of the upper control shaft 32. The middle section of the lower control shaft 33 is further disposed of a plurality of stop piece slant surfaces 332, a plurality of brake piece slant surfaces 335, and a plurality of second grooves 333. A second cylinder body 334 is disposed at and extends from the lower section of the lower control shaft 33.

A spring 34 fits with the second cylinder body 334 of the lower control shaft 33. A water inlet cylinder 35 that is a hollow cylinder body with an opening facing downwards; wherein a water outlet hole 351 is disposed at top end thereof to allow insertion of the second cylinder body 334.

A water inlet base 36 fits with the water inlet cylinder 35, wherein a partition plane 361 is disposed at the center of the water inlet base 36, and a plurality of water inlet holes 362 is disposed adjacent to the partition plane 361.

The water outlet plate 4 has a plate surface 410, whereon a plurality of water outlet holes 412 is disposed thereof. A fifth through hole 411 is disposed at the center of the water outlet plate 4, wherein a first joining base 414 extends downwards from the inner wall of the fifth through hole 411; the middle section of the fifth through hole 411 further comprises a second inner thread section 413 to fixedly join to the first outer thread section 313. The fifth through hole 411 contains a control button 42 thereof, wherein the control button 42 is a hollow cylinder body with an opening facing downwards and has a connecting piece 421 at the center thereof. The connecting piece 421 is to fit with and connect to the third through hole 321.

Figure 5:
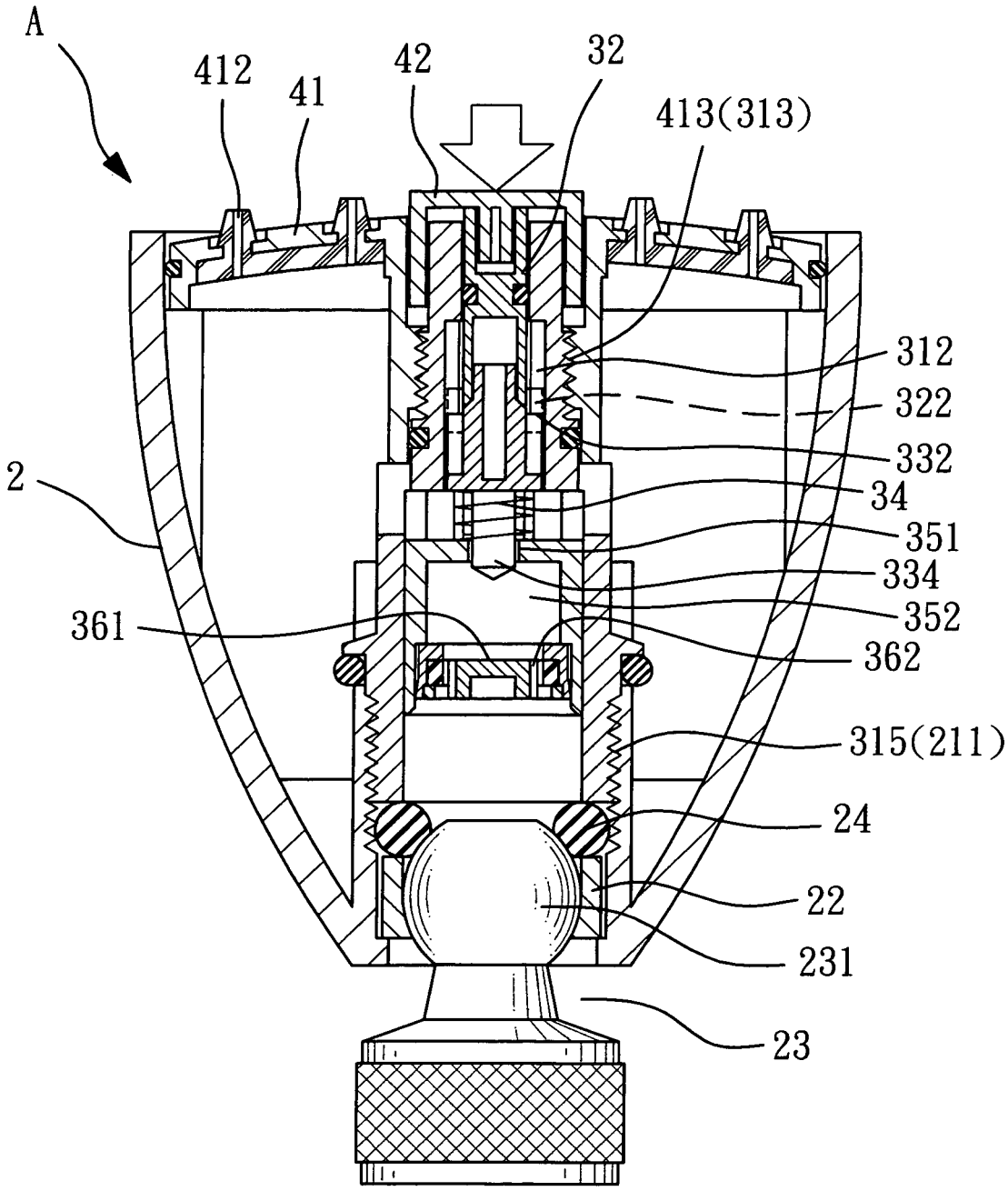
FIG. 5 is a sectional view of wall mounted shower head turning off water according to the present invention.
Figure 6:
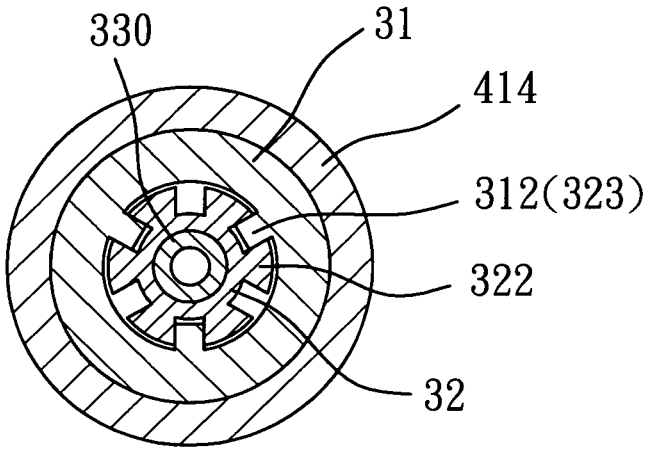
FIG. 6 is an I-I line sectional view according to the present invention.
Figure 7:
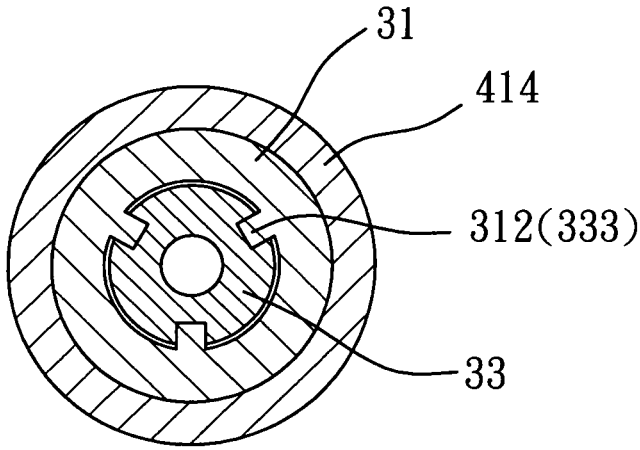
FIG. 7 is an II-II line sectional view according to the present invention.
Figure 8:
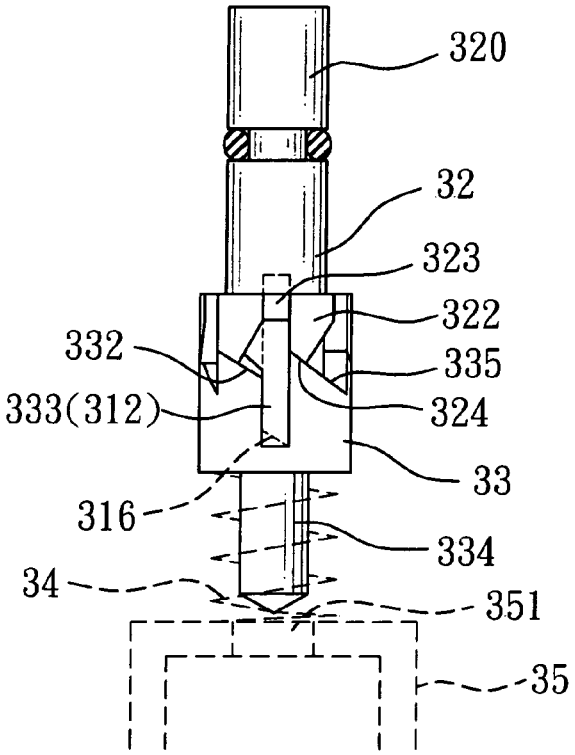
FIG. 8 is a partial view of wall mounted shower head discharging water according to the present invention.
Figure 9:
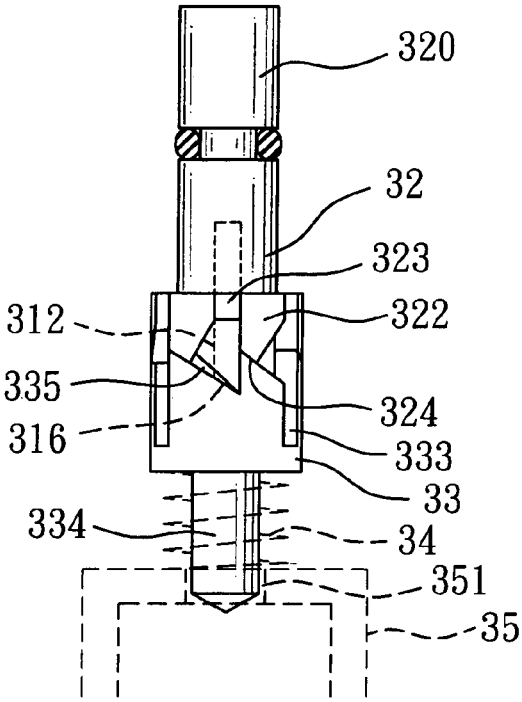
FIG. 9 is a partial view of wall mounted shower head turning off water according to the present invention.

By assembling the foregoing assemblies, the users are capable of controlling the inlet and outlet of the shower water by pressing the control button 42. Referring to FIGS. 4, 6, 7 and 8, wherein the wall mounted shower head A provides shower water, the control button 42 is at a water outlet position. The path of the shower water is described hereinafter; the water passes through the water inlet holes 362 of the water inlet base 36 from the ball joint tube 23 and enters the water inlet cylinder 35; the shower water then exits from the water outlet hole 351 and enters the water conduit base 31; and then the shower water exits the water conduit base 31 from the water outlet 314 and gushes out of the wall mounted shower head A from the water outlet holes 412 of the water outlet plate 4. As the users wish to turn off the shower water, they could simply press the control button 42 with their finger, wherefrom the control button 42 will be pushed downwards and presses the upper control shaft 32 and then the lower control shaft 33 to move downwards. The slant cone part 324 of the stop pieces 322 of the upper control shaft 32 then moves rightwards and downwards along the stop piece slant surfaces 332 of the lower control shaft 33, guiding the slant surface 316 of the guide ribs 312 to be embedded into the brake piece slant surfaces 335. As illustrated in FIGS. 5 and 9, the lower control shaft 33 further presses the spring 34 and the second cylinder body 334 thereby inserts the water outlet hole 351 of the water inlet cylinder 35 to stop the wall mounted shower head A from providing shower water. When the users are in need of shower water again, they could again pressing the control button 42; wherein the pressing force further compresses the spring 34. As the finger is removed from the control button 42, the resilient restoring force of the spring 34 pushes the upper control shaft 32 upwards and therefrom disengaging the slant surface 316 of the guide ribs 312 from the brake piece slant surfaces 335 and actuates the lower control shaft 33 to move upwards. The first groove 323 and the second groove 333 slide upwards along the guide ribs 31, and the second cylinder body 334 is disengaged from the water outlet hole 351. The shower water flows into the water conduit base 31 from the water outlet hole 351 and flows out of the water conduit base 31 from the water outlet 314; and then the shower water gushes out of the wall mounted shower head A from the water outlet holes 412 of the water outlet plate 4, as illustrated on FIG. 4.

As the foregoing, with a two-stage press control button users can control the inlet and outlet of the shower water easily; the structure provides a convenient water control operation for users in shower.

While the invention has been described with reference to a preferred embodiment thereof, it is to be understood that modifications or variations may be easily made without departing from the spirit of this invention, which is defined in the appended claims.

I claim:

1. A wall mounted shower head comprising a casing body set, a water conduit set and a water outlet plate; the water conduit set is disposed inside the casing body set, wherein an upper section of the water conduit set is joined to a first joining base of the water outlet plate and a bottom section of the water conduit set is joined to a second joining base of the casing body set; wherein:

the casing body set is an outer casing having a hollow receiving chamber; wherein the second joining base has a first through hole and a first inner thread section and is disposed in a bottom part of the hollow receiving chamber; a ball joint tube is disposed at and is inserted into the first through hole, and the ball joint tube provides a ball body having a penetration hole;

the water conduit set comprises:

a water conduit base having a second through hole, wherein a plurality of guide ribs are disposed on an inner wall of the second through hole; each of the plurality of guide ribs has a slant surface at a bottom end thereof, and an upper section of the water conduit base includes a first outer thread section, wherein at least one water outlet is disposed below the first outer thread section; a second outer thread section is provided at a lower section of the water conduit base and is fixedly joined to the first inner thread section of the casing body set;

an upper control shaft disposed through the second through hole, wherein a shaft body of the upper control shaft has a third through hole and a fourth through hole; the shaft body further provides a plurality of stop pieces at a lower section thereof, wherein a first groove is disposed between each two stop pieces;

a lower control shaft having a first cylinder body, wherein the first cylinder body fits with the fourth through hole of the upper control shaft; a middle section of the lower control shaft includes a plurality of stop piece slant surfaces, a plurality of brake piece slant surfaces, and a plurality of second grooves, wherein a second cylinder body is disposed at and extends from a lower section of the lower control shaft;

a spring fitting with the second cylinder body of the lower control shaft;

a water inlet cylinder that is a hollow cylinder body with an opening facing downwards; wherein a water outlet hole is disposed at a top end thereof to allow insertion of the second cylinder body; and a water inlet base fitting within the water inlet cylinder;

the water outlet plate has a plate surface and a plurality of water outlet holes disposed thereon; a fifth through hole is disposed at the center of the water outlet plate wherein the first joining base extends downwards from an inner wall of the fifth through hole; a middle section of the fifth through hole further comprises a second inner thread section to fixedly join to the first outer thread section; and the fifth through hole contains a control button.

2. The wall mounted shower head as defined in claim 1, wherein an inner side of the hollow receiving chamber of the outer casing includes a plurality of support ribs.

3. The wall mounted shower head as defined in claim 1, wherein the ball body is disposed between a water-stop pad and a water-stop ring.

4. The wall mounted shower head as defined in claim 1, wherein a partition plane is disposed at the center of the water inlet base; a plurality of water inlet holes are disposed adjacent to the partition plane.

5. The wall mounted shower head as defined in claim 1, wherein the control button is a hollow cylinder body with an opening facing downwards and has a connecting piece at the center thereof; the connecting piece fits with and connects to the third through hole.

6. The wall mounted shower head as defined in claim 1, wherein each of the plurality of stop pieces of the upper control shaft has a slant cone part at a bottom thereof.

* * * * *